US007679573B2

(12) United States Patent
Shuster et al.

(10) Patent No.: US 7,679,573 B2
(45) **Date of Patent: *Mar. 16, 2010**

(54) ENCLOSED MOBILE/TRANSPORTABLE MOTORIZED ANTENNA SYSTEM

(75) Inventors: Sam Shuster, Edina, MN (US); Lael King, Minneapolis, MN (US)

(73) Assignee: King Controls, Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/004,099

(22) Filed: Dec. 19, 2007

(65) Prior Publication Data

US 2008/0246677 A1 Oct. 9, 2008

Related U.S. Application Data

(60) Provisional application No. 60/888,673, filed on Feb. 7, 2007.

(51) Int. Cl.
*H01Q 3/00* (2006.01)

(52) U.S. Cl. ..... 343/766

(58) Field of Classification Search ..... 343/765–766, 343/757; 342/75–76, 352
See application file for complete search history.

(56) References Cited

U.S. PATENT DOCUMENTS

| | | | |
|---|---|---|---|
| 2,814,038 | A | 11/1957 | Miller |
| 3,071,338 | A | 1/1963 | Kaufman et al. |
| 3,388,401 | A | 6/1968 | Weir |
| 3,599,218 | A | 8/1971 | Williamson et al. |
| 3,781,898 | A | 12/1973 | Holloway et al. |
| 3,918,065 | A | 11/1975 | Hutchinson et al. |
| 4,096,481 | A | 6/1978 | Widmer et al. |
| 4,190,839 | A | 2/1980 | Liautaud |
| 4,282,530 | A | 8/1981 | Semplak |

(Continued)

FOREIGN PATENT DOCUMENTS

| | | | |
|---|---|---|---|
| FR | 2589633 | A1 | 5/1987 |

(Continued)

OTHER PUBLICATIONS

Search Report and Written Opinion for WO 2008/098121 A1, dated Jun. 25, 2008, 8 pages.

(Continued)

*Primary Examiner*—Huedung Mancuso
(74) *Attorney, Agent, or Firm*—Ulbrich I.P., Ltd.

(57) ABSTRACT

An enclosed satellite antenna system can include a generally rigid enclosure defining a volume that is configured to enable both manual transportability of the satellite antenna system and automated operation of the satellite antenna system without a substantial change in the volume of the enclosure or manual repositioning of the satellite antenna system. The enclosure can have disposed therein a satellite dish, a feedhorn configured to collect incoming signals concentrated by the satellite dish, and a low noise block converter configured to receive incoming signals from the feedhorn, amplify and convert the incoming signals to received signals, and transmit the received signals to at least one receiver. A motorized elevation dravie system can be configured to selectively adjust an elevation of the satellite dish and a motorized azimuth drive system can be configured to selectively rotate the satellite dish. A control system can be connected to the elevation drive system and the azimuth drive system to control automated operation of the satellite antenna system.

25 Claims, 15 Drawing Sheets

U.S. PATENT DOCUMENTS 4,309,708 A 1/1982 Sayovitz
4,649,675 A 3/1987 Moldovan et al.
4,654,670 A 3/1987 Fleming
4,771,293 A 9/1988 Williams et al.
4,804,972 A * 2/1989 Schudel ..... 343/840
4,868,575 A 9/1989 Mok et al.
4,918,459 A 4/1990 De Teso
4,939,524 A 7/1990 Blaese
4,946,736 A 8/1990 Sassa
4,998,114 A 3/1991 Eto et al.
5,019,833 A 5/1991 Nonaka
5,088,680 A 2/1992 Farmer
D333,470 S 2/1993 Vong
5,218,369 A 6/1993 Jennings
5,274,382 A 12/1993 Wills et al.
5,296,862 A 3/1994 Rodeffer et al.
5,309,162 A 5/1994 Uematsu et al.
5,337,062 A 8/1994 Sherwood et al.
5,347,286 A 9/1994 Babitch
5,398,035 A * 3/1995 Densmore et al. ..... 343/713
5,418,542 A 5/1995 Sherwood et al.
5,419,521 A 5/1995 Matthews
5,448,254 A * 9/1995 Schneeman et al. ..... 343/781 R
5,451,972 A 9/1995 Franklin
5,471,219 A 11/1995 Rodeffer et al.
D364,874 S 12/1995 Cheng
5,515,065 A 5/1996 Sherwood et al.
5,528,250 A * 6/1996 Sherwood et al. ..... 343/711
5,528,253 A 6/1996 Franklin
5,543,814 A 8/1996 Jenness, Jr.
5,585,804 A 12/1996 Rodeffer
5,619,215 A 4/1997 Sydor
5,646,638 A 7/1997 Winegard et al.
5,675,348 A 10/1997 Okada et al.
5,689,276 A 11/1997 Uematsu et al.
5,714,963 A 2/1998 Cox
5,729,241 A 3/1998 Ergen et al.
5,760,751 A 6/1998 Gipson
5,815,125 A 9/1998 Kelly et al.
5,819,185 A 10/1998 Umezawa et al.
5,877,730 A 3/1999 Foster
5,892,488 A 4/1999 Dulon
5,945,945 A * 8/1999 Wagner et al. ..... 342/359
5,949,386 A 9/1999 Elliott
5,983,071 A 11/1999 Gagnon et al.
6,023,245 A 2/2000 Gomez et al.
6,072,440 A 6/2000 Bowman
6,175,171 B1 1/2001 Rupp et al.
6,188,367 B1 2/2001 Morrison et al.
6,191,752 B1 2/2001 Lester et al.
6,191,753 B1 2/2001 Ellis et al.
6,191,820 B1 2/2001 Kang et al.
6,204,820 B1 3/2001 Jensen, Jr.
D440,961 S 4/2001 Inoue
D440,965 S 4/2001 Inoue
D442,167 S 5/2001 Emery
6,266,017 B1 7/2001 Aldous
6,292,155 B1 9/2001 McPhilmy et al.
D468,302 S 1/2003 Sato
6,512,490 B1 1/2003 Lee
D470,131 S 2/2003 Noro et al.
6,531,990 B2 3/2003 Verkerk
6,538,612 B1 3/2003 King
D480,712 S 10/2003 Noro
6,682,029 B1 1/2004 Dierkes
6,693,587 B1 2/2004 Kuether et al.
6,701,749 B2 3/2004 King
6,710,794 B1 3/2004 Yamazaki et al.
6,714,167 B1 3/2004 Gusick, Jr.
6,762,727 B2 7/2004 Rochford et al.
6,844,855 B2 1/2005 Carson
6,864,846 B2 3/2005 King
6,937,199 B2 8/2005 King
7,227,506 B1 6/2007 Lewis, Jr.
7,230,581 B2 6/2007 McEwan
7,268,734 B2 9/2007 Cislo
7,301,505 B2 * 11/2007 King ..... 343/757
7,372,428 B1 5/2008 King
7,477,203 B2 * 1/2009 Park ..... 343/765
2004/0080461 A1 4/2004 Rothgeb et al.
2005/0225495 A1 10/2005 King
2007/0007402 A1 1/2007 Dierkes
2007/0252765 A1 11/2007 Jayasuriya et al.
2008/0136722 A1 6/2008 King
2009/0040130 A1 2/2009 Conrad
2009/0085825 A1 4/2009 Conrad
2009/0085826 A1 4/2009 Conrad

FOREIGN PATENT DOCUMENTS

JP 2005-203978 A 7/2005
WO WO 2008/098121 A1 8/2008

OTHER PUBLICATIONS

KVH Industries, Inc., A Guide to TracVision LM, 1999, 49 pages.
KVH Industries, Inc., A Guide to TracVision L3/S3—Owner's Manual, 2003, 77 pages.
KVH Industries, Inc., A Guide to TracVision G4—Owner's Manual, 1999, 133 pages.
KVH Industries, Inc., A Guide to TracVision R4/R5—Owner's Manual, 2005, 66 pages.
KVH Industries, Inc., TracVision 45 manual, 1998, 47 pages.
Datron/Transco Inc. brochure, Product Information sheet for DBS-3000 Mobile Satellite Television System, Dec. 1996, 2 pages.
Datron/Transco Inc. Installation Instructions for DBS-30500 Mobile Satellite Television System, 1999, 23 pages.
Datron/Transco Inc., News Release dated Jul. 17, 1996 with information sheet for DBS-4000 In-Motionj Satellite System, 3 pages.
Datron/Transco Inc. Installation Instructions for DBS-4000-100 In-Motion Satellite Television System, 1996, 24 pages.
Datron/Transco Inc. product Information sheet for DBS-4000 In-Motion Digital Satellite Television Reception System, undated, 2 pages.
Sea Tel Inc., Operation and Installation Manual for Sea Tel Model 1898 Shipboard Satellite TV System, Oct. 2001, 51 pages.
Sea Tel Inc., Installation and Operation Manual for Sea Tel Model 2094 Shipboard Satellite TV Receive-Only System, May 1996, 81 pages.
Sea Tel Inc., Installation and Operation Manual for Sea Tel Model Coastal 18 Satellite TV Receive-Only Antenna with Motorized Polarization, Feb. 23, 2006, 88 pages.
King Controls Brochure for King Dome Automatic Satellite System, 1998, 2 pages.
King Controls, Installation and Operating Instructions manual for 9702 and 9702L-LP Automatic Satellite System, undated, 18 pages.
King Dome Satellite Locator System product information, Mar. 5, 1999, 47 pages.
Telemetry & Communications Systems, Inc., Model 600 Portable Antenna System, Sep. 2003, 2 pages.
Winegard Co., Installation/Operation manual for RoadTrip LP1000 Satellite System, Jul. 20, 2004, 20 pages.
Winegard Co., manual for Movin View Digital Satellite Mobile Antenna for Two Receivers Model MV3500A, May 2005, 12 pages.

* cited by examiner

ENCLOSED MOBILE/TRANSPORTABLE MOTORIZED ANTENNA SYSTEM

PRIORITY CLAIM

The present application claims priority to U.S. Provisional Application No. 60/888,673, filed Feb. 7, 2007, which is hereby incorporated by reference in its entirety.

FIELD OF THE INVENTION

The present invention relates to satellite antenna systems. More particularly, the present invention relates to an enclosed mobile satellite antenna system that provides for an easily manually transportable enclosed mobile/transportable satellite antenna system that does not require set up or assembly.

BACKGROUND OF THE INVENTION

The current state of the art and practice for enclosed, environmentally protected mobile satellite radome antenna system receiving signals for digital television, such as Ku-band and Ka-band signals, and digital radio is to mount the antenna to the roof or top, flat surface of a vehicle or other structure. Typically, these satellite antenna systems are mounted to a top surface, directly or with a bracket, and have one or more wire harnesses to communicate between a remote, an external radome antenna to control antenna position and signal acquisition, and a wire harness dedicated for power. The radomes themselves—the enclosure housing the antenna and peripheral devices—for mounted mobile satellite systems are generally spherical with the base having a similar or larger diameter than the cover at its widest point and a flat bottom.

This current configuration used for such systems limits their use on structures and vehicles without a flat roof or flat mounting surface or higher profile vehicles like tractor-trailer trucks. When mounted at an angle (or not flat), current designs for mobile satellite antennas will lose dynamic range. Moreover, the spherical shape and large base footprint make mounting to a flat side of a structure cumbersome and, in the case of some vehicles, such as tractor trailers, unsafe because of the limited space between the truck and trailer. Such systems also typically must be mounted in a manner in which they are not easily removable, which limits the versatility of the system and can require permanent alterations to the structure. In addition, the multiple wires needed to connect components inside the structure with components outside the structure can be cumbersome and make installation difficult. The geometry of such systems also makes them difficult and awkward to transport from place to place.

Some satellite systems are equipped with handles to allow the systems to be carried to new locations. Such systems typically fold into a suitcase-like configuration for transportation. However, because such systems fold-up to be carried, time must be taken to set the system up for use once it has been transported to a desired location.

SUMMARY OF THE INVENTION

The present disclosure is directed to an enclosed mobile/transportable satellite antenna system. In one embodiment, an enclosed satellite antenna system can include a generally rigid enclosure defining a volume that is configured to enable both manual transportability of the satellite antenna system and automated operation of the satellite antenna system without a substantial change in the volume of the enclosure or manual repositioning of the satellite antenna system. The enclosure can have disposed therein a satellite dish, a feedhorn configured to collect incoming signals concentrated by the satellite dish, and a low noise block converter configured to receive incoming signals from the feedhorn, amplify and convert the incoming signals to received signals, and transmit the received signals to at least one receiver. A motorized elevation drive system can be configured to selectively adjust an elevation of the satellite dish and a motorized azimuth drive system can be configured to selectively rotate the satellite dish. A control system can be connected to the elevation drive system and the azimuth drive system to control automated operation of the satellite antenna system.

In another embodiment, a satellite antenna system can include an enclosure comprised of a cover including a top surface and a plurality of flat, angled side surface and a base including a bottom surface and a plurality of flat, angled side surfaces. Where cover and base meet, a plurality of flat, generally vertical side surfaces are formed. A satellite dish can be disposed within the enclosure along with a feedhorn to collect incoming signals concentrated by the satellite dish and a low noise block converter configured to receive incoming signals from the feedhorn, amplify and convert the incoming signals to received signals, and transmit the received signals to at least one receiver. A motorized elevation drive system can be configured to selectively adjust an elevation of the satellite dish and a motorized azimuth drive system can be configured to selectively rotate the satellite dish. A control system can be connected to the elevation drive system and the azimuth drive system to control automated operation of the satellite antenna system.

BRIEF DESCRIPTION OF THE FIGURES

These as well as other objects and advantages of this invention will be more completely understood and appreciated by referring to the following more detailed description of the presently preferred exemplary embodiments of the invention in conjunction with the accompanying drawings of which.

DETAILED DESCRIPTION OF THE FIGURES

Figure 1:
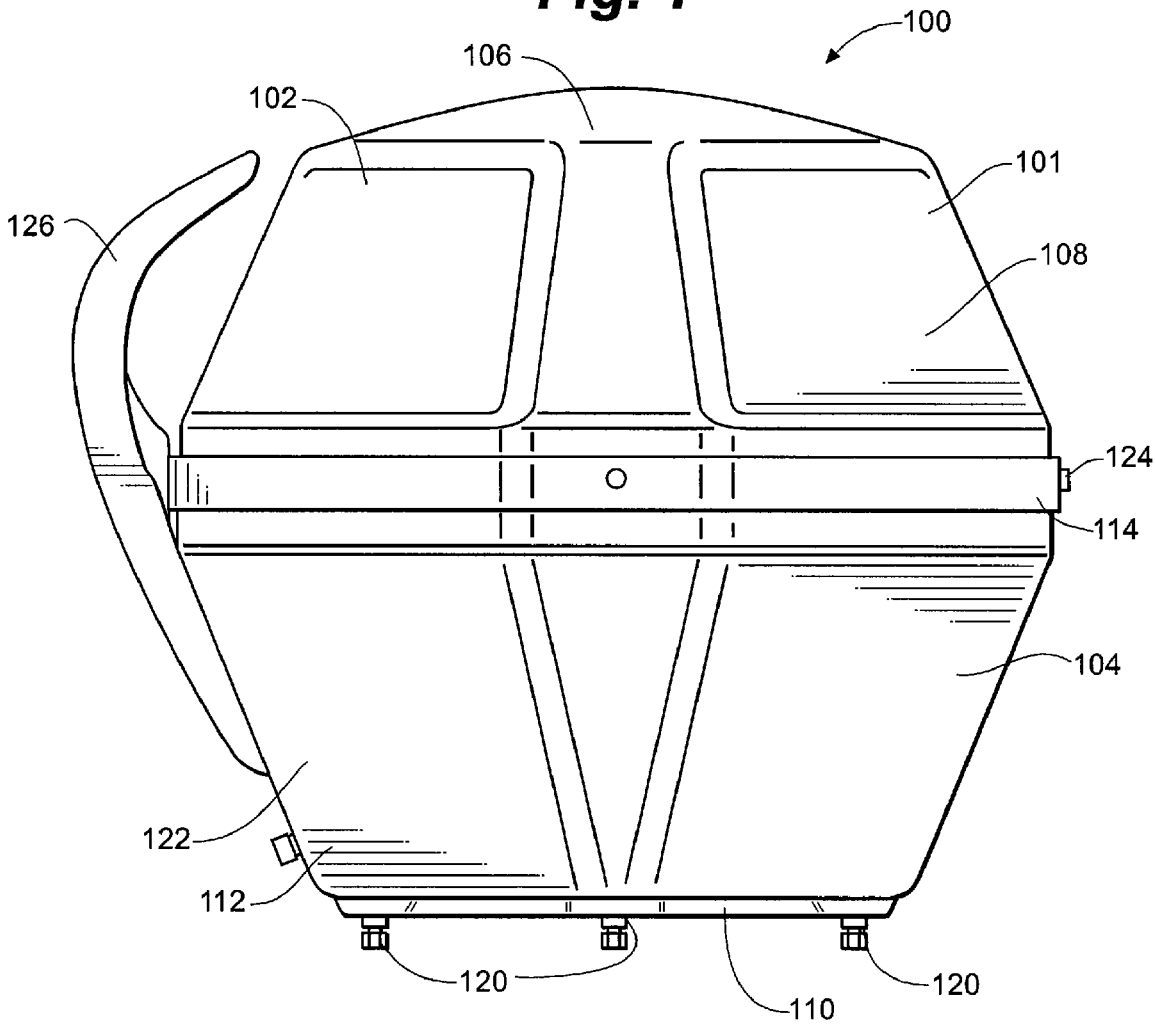
FIG. 1 is an enclosed mobile satellite antenna system according to one example embodiment.
Figure 2:
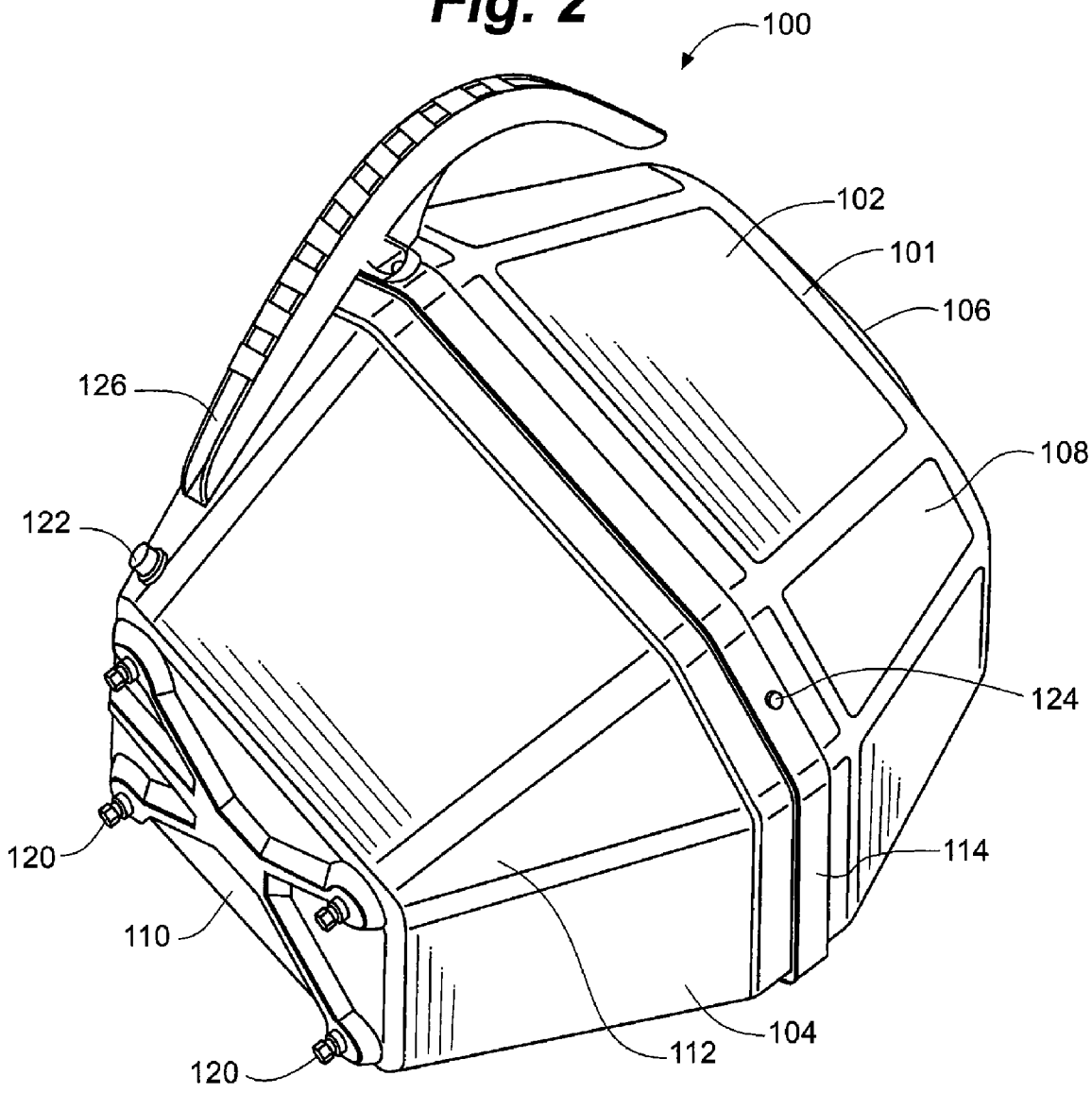
FIG. 2 is an enclosed mobile satellite antenna system according to one example embodiment.
Figure 3:
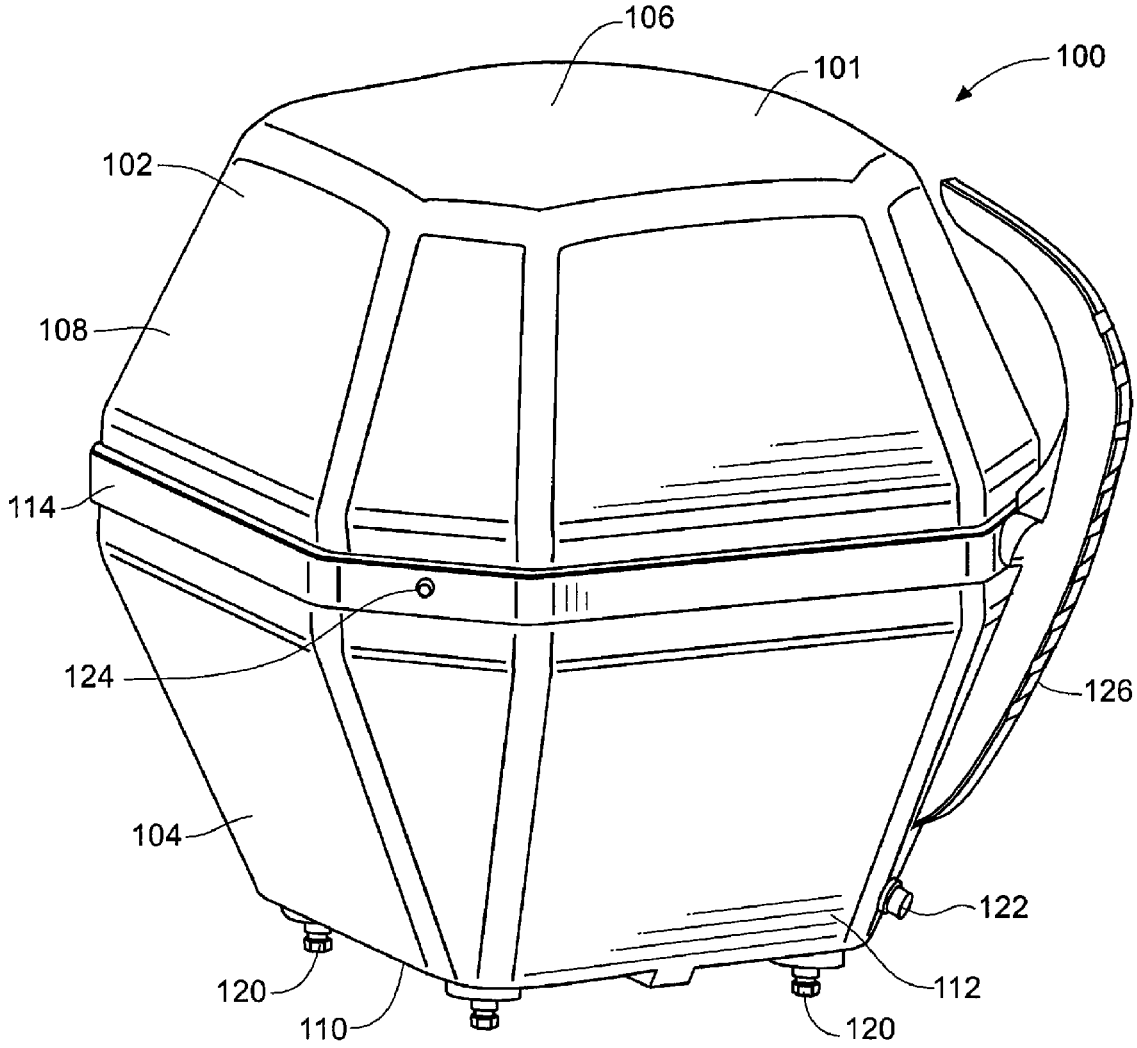
FIG. 3 is an enclosed mobile satellite antenna system according to one example embodiment.
Figure 4:
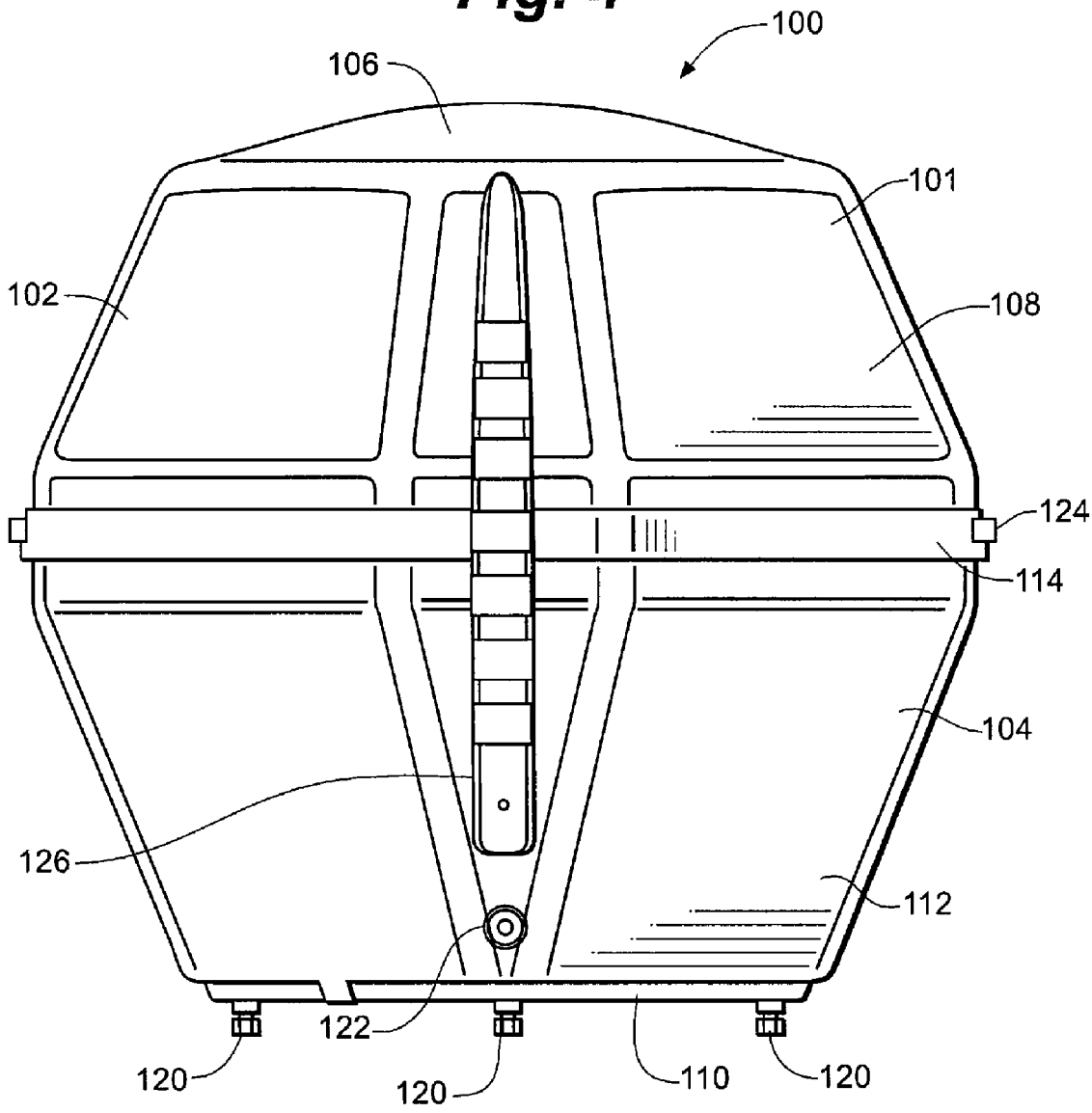
FIG. 4 is an enclosed mobile satellite antenna system according to one example embodiment.

Referring to FIGS. 1-4, there can be seen an enclosed mobile satellite antenna system 100 according to an example embodiment of the present invention. Enclosed mobile satellite antenna system 100 includes an enclosure 101 with a satellite antenna system therein for acquiring and transmitting a satellite signal. Enclosure 101 includes a cover 102 and a base 104. Enclosure 101 is dielectric and is preferably made out of a ultra-violet protected lightweight plastic or other electromagnetic wave permeable material. Enclosure 101 is environmentally protected to prevent satellite antenna and related structure contained therein, such as one or more antenna positioning motors, antenna positioning control electronics, a satellite signal collecting and amplifying device, and ancillary electronics and devices to provide feedback to a user regarding the satellite antenna system and signal acquisition function and status, from becoming damaged by the outside environment.

In one embodiment, cover 102 can include a top surface 106 and a plurality of flat, angled side surfaces 108. Top surface 106 can be flat or slightly curved. Angled side surfaces 108 diverge at an angle greater than 90 degrees relative to top surface 106. The inner surface of the top surface 106 of cover 102 can be concave in order to increase the interior volume of the enclosure. Concave inner surface of top surface 106 also serves to minimize signal loss caused by water contacting the enclosure.

In one embodiment, base 104 can include a flat bottom surface 110 and a plurality of flat, angled side surfaces 112. Angled side surfaces 112 of base 104 diverge at an angle greater than 90 degrees relative to bottom surface 110. Base 104 preferably has a footprint small enough to fit on current brackets commonly found on the back of long-haul trucks for logistical communication hardware. The use of such existing brackets to mount an enclosed mobile satellite antenna system 100 results in cost savings and easier installation. Base 104 can further include a plurality of feet 120 on which enclosure 101 can rest to prevent damage to bottom surface 110. Base 104 can also include a coaxial connector 122 to which a cable can be connected for powering and/or receiving signals from or sending signals to the satellite antenna system contained inside the enclosure 101. Connector 122 can protrude out of one of the angled side surfaces 112 or out of bottom surface 110.

In one embodiment, cover 102 and base 104 can be generally symmetrical with each other in size and shape. Cover 102 and base 104 can be engaged to one another with screws 124. Where cover 102 and base 104 meet, a flat surface 114 can be formed that is generally perpendicular to top surface 106 and/or bottom surface 110. This flat surface 114 can be abutted directly adjacent the side of a vehicle or other structure to minimize the distance that the satellite antenna system and enclosure protrude from the structure. A handle 126 can be affixed to cover 102 and/or base 104 for easy transportation of enclosure 101.

The geometry of the enclosure 101, including the angled side surfaces 108, 112 and concave inner surface of top surface 106, allows a parabolic dish contained therein to have a large surface area relative to the volume of the enclosure. In one embodiment, an enclosure 101 having a volume of 2,615 cubic inches can contain a satellite antenna having a parabolic dish having a surface area of 177.19 square inches. This yields a ration of cubic volume to dish area of about 14.76 to 1. This allows maximum signal to be obtained with the smallest profile and dimensioned enclosure 101. A smaller enclosure 101 also weighs less, which eases installation, minimizes damage to the satellite antenna components caused by movement and vibration, and increases portability for non-permanently mounted enclosures. In one embodiment, the enclosure 101 can have a smaller base bottom surface 110 than the diameter of the dish contained therein. This requires the center of mass of the system to be positioned such that the enclosure does not tip over when rested on bottom surface. In addition, the angled sides lessen the effects of signal loss caused by moisture or condensation such as dew, rain, sleet, or snow (rain fade).

An enclosed mobile satellite antenna system according to the present invention can be mounted in the standard fashion on a flat top surface of a vehicle and can also be mounted on either the side or the rear of a vehicle. Examples of such vehicles include long-haul trucks, vans, SUVs, trailers, motor homes, and boats. Enclosed mobile satellite antenna system can also be mounted on other structures. Such structures include buildings, fences, railings, and poles.

Enclosed mobile satellite antenna system can be mounted to a vehicle or other structure with a mounting means, such as a bracket or a docking station, in either a permanent or a non-permanent manner. The system can be placed on top of or nested into a mounting means and can rest upon or attach to the mounting means. System can be attached to a mounting means by various means, such as, for example, nuts and bolts, suction cups, clips, snaps or a pressure fit. Mounting means can include an anti-theft mechanism such as a lock or an alarm triggered by the removal of the system from the mounting means. In one embodiment, mounting means can be provided with an anti-theft mechanism whereby when a tilt sensor used in positioning the satellite antenna dish experiences a large level change (thereby indicating it has been removed from the mounting means), it sets off an alarm.

A mounting means can be attached to a vehicle or other structure permanently or semi-permanently. The components of a mounting means can be made out of a variety of materials such as, for example, aluminum, steel, plastic, rubber, or some combination of materials. Mounting means can attach to a structure by various means, including nuts and bolts, tape, glue, suction cups, clips, or snaps. The mounting means components can be constructed in such a way as to allow any wire connections between the outside of a structure and the inside of the structure to be directly connected, to connect by passing through the mounting means, or to connect by plugging directly into the mounting means.

In one embodiment, the bracket components can be attached to a window. Any necessary wiring between the enclosed mobile satellite antenna system and the inside of the vehicle or other structure can be passed through the window while it is open. The bracket components can then be secured in place by rolling up or otherwise partially closing the window. In other embodiments, the bracket can be hung on a ladder secured to the vehicle or other structure or on any other surface that the bracket components can hook to, such as side mirrors or yokes. Any necessary wiring can be passed through the nearest opening in the structure to connect the enclosed mobile satellite antenna system with the interior of the structure. Brackets can be designed to allow flat side surfaces of enclosed mobile satellite antenna system to mount flushly with and directly abut the structure. This increases safety by providing for less overhang of the system from the structure. In the case of vehicles such as long haul trucks, flush mounting or near flush mounting maximizes the distance between truck and trailer, which allows the system to be used on a greater variety of vehicles.

Figure 5:
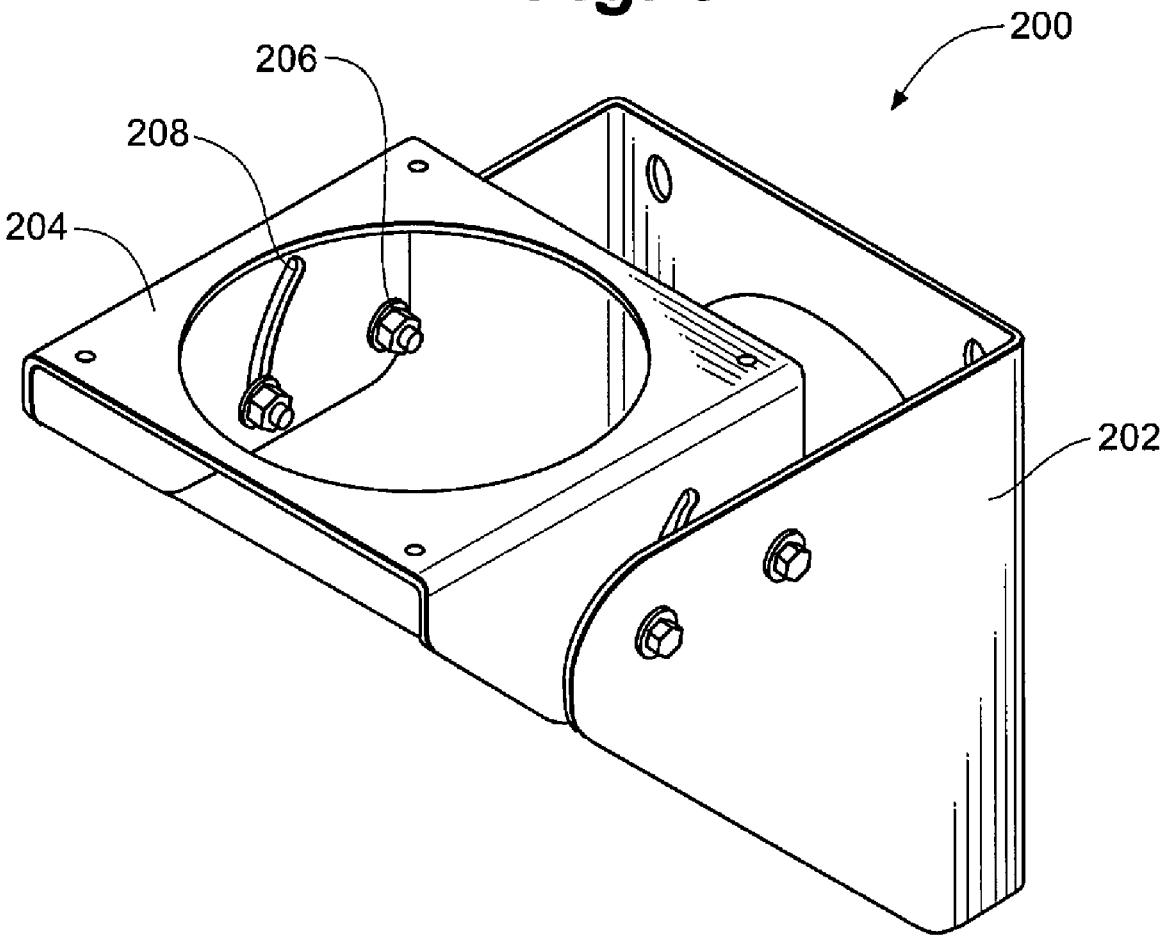
FIG. 5 is a mounting means for an enclosed mobile satellite antenna system according to one example embodiment.
Figure 6:
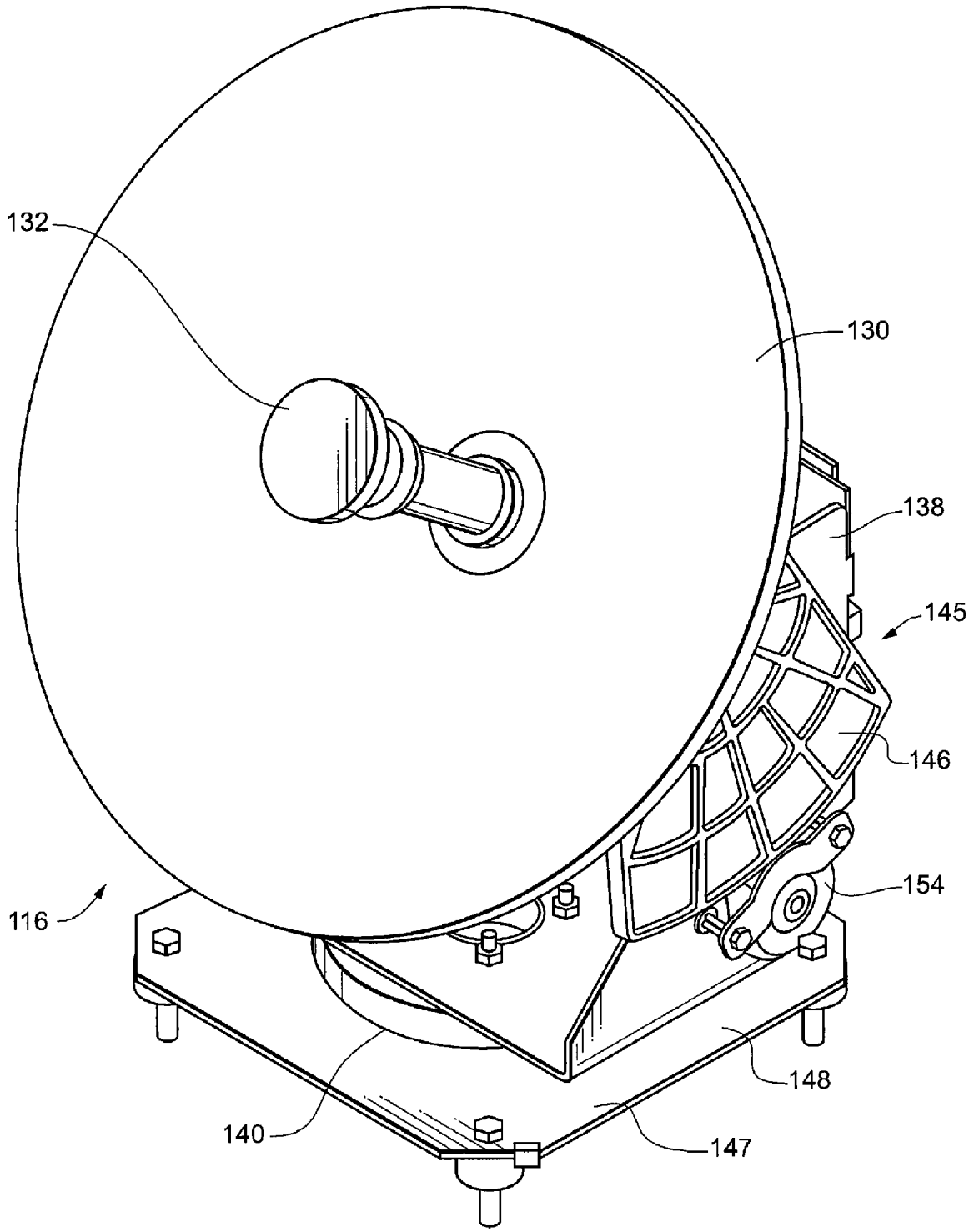
FIG. 6 is a satellite antenna system for an enclosed mobile satellite antenna system according to one example embodiment.
Figure 7:
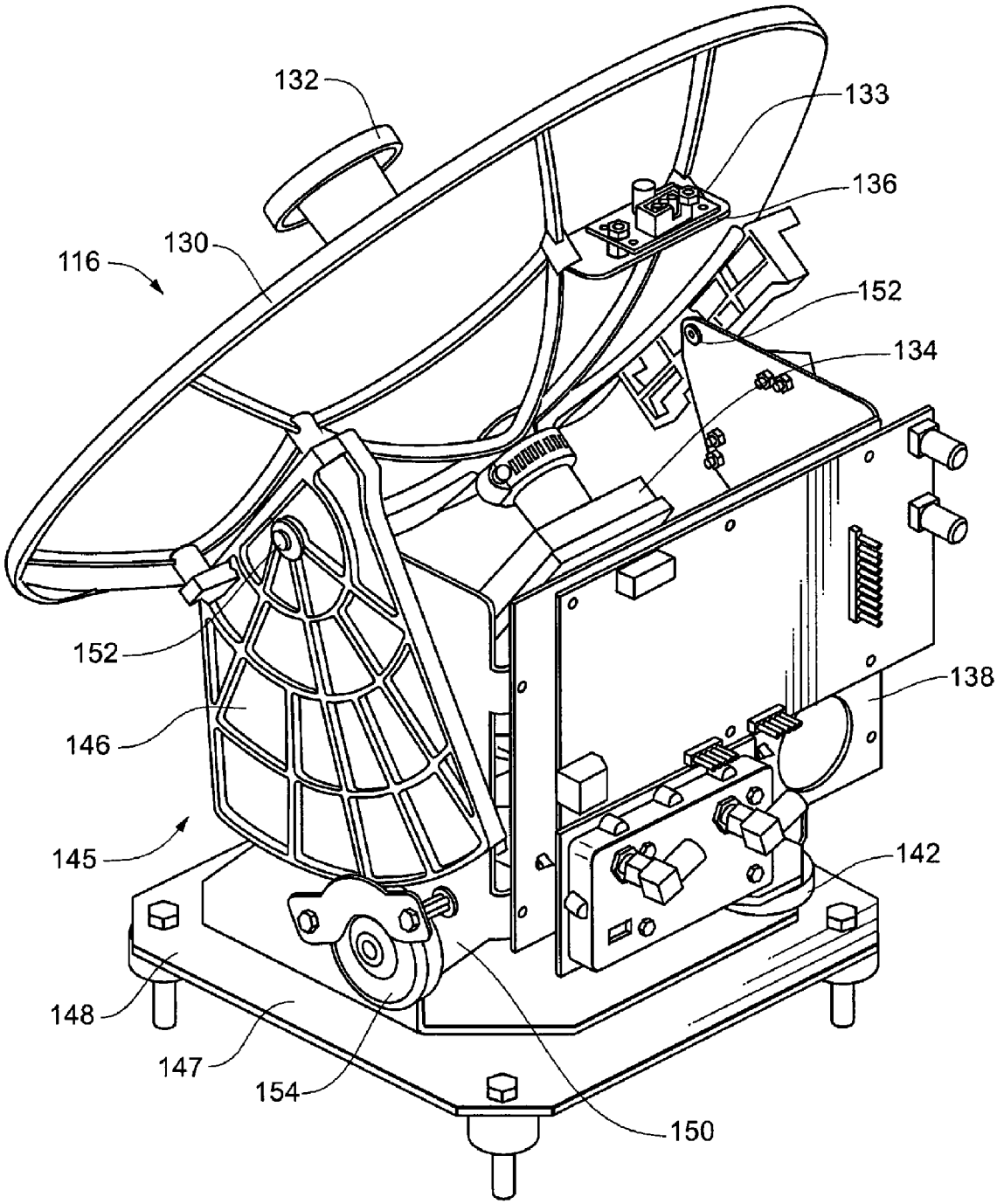
FIG. 7 is a satellite antenna system for an enclosed mobile satellite antenna system according to one example embodiment.
Figure 8:
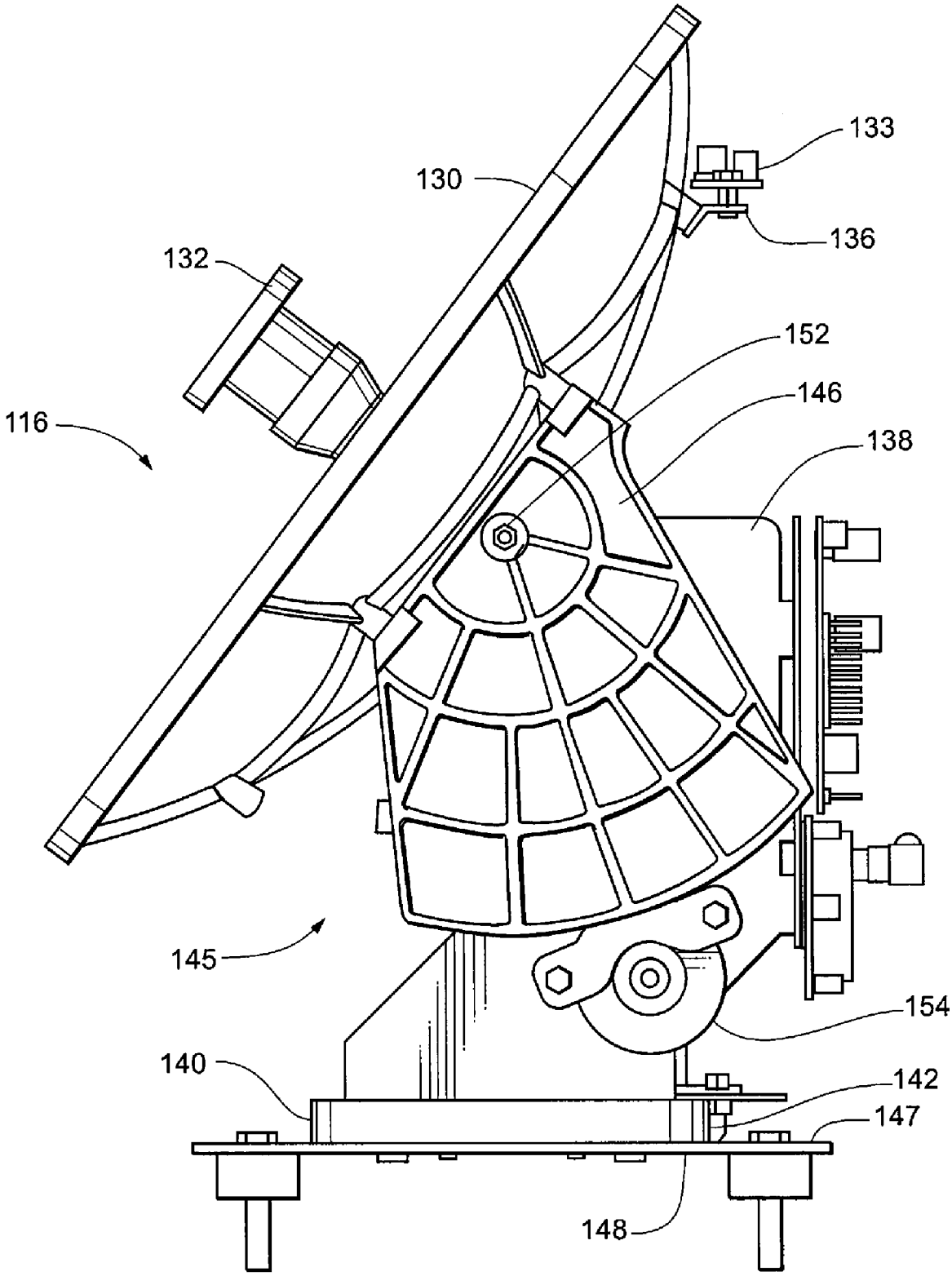
FIG. 8 is a satellite antenna system for an enclosed mobile satellite antenna system according to one example embodiment.
Figure 9:
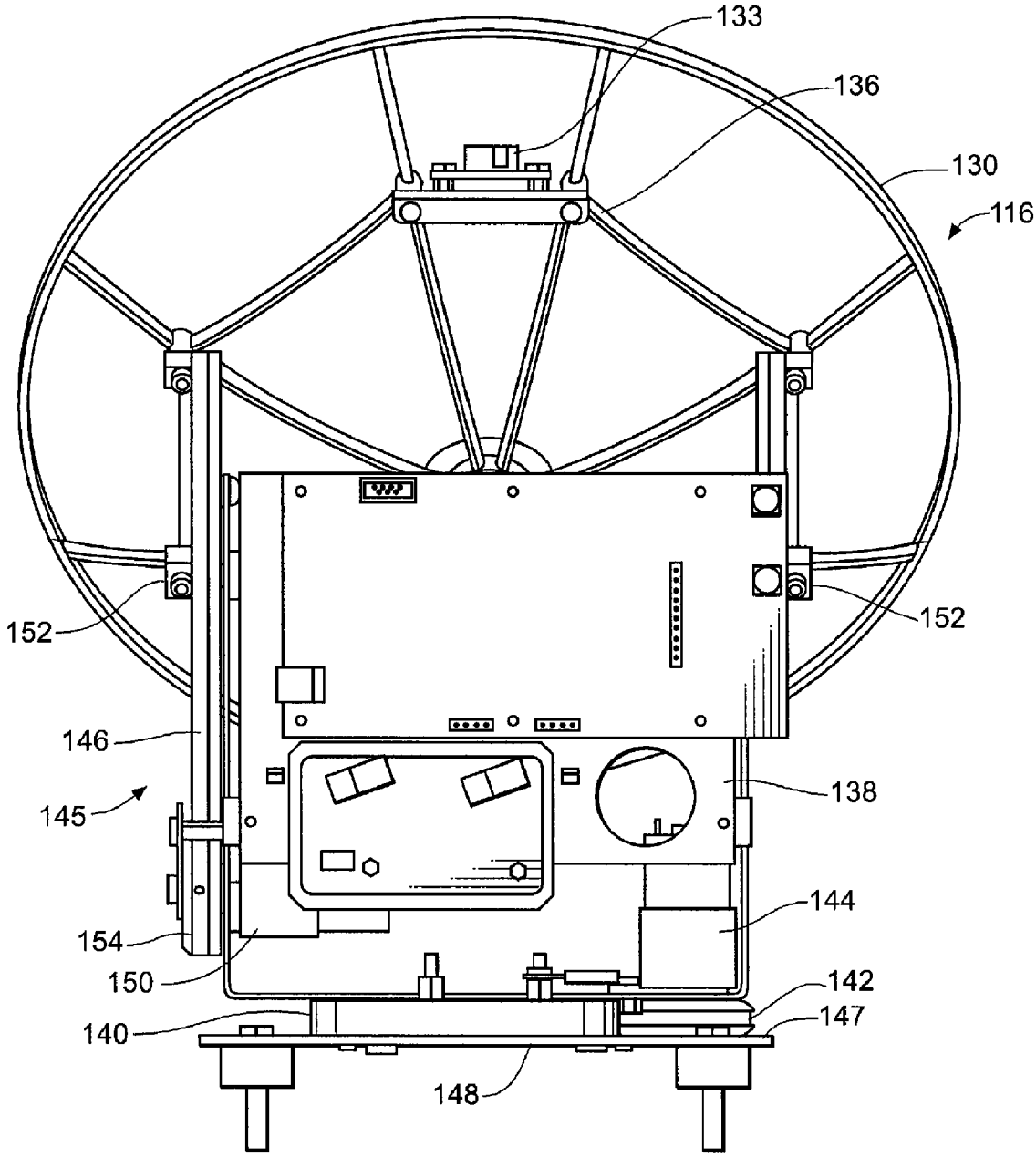
FIG. 9 is a satellite antenna system for an enclosed mobile satellite antenna system according to one example embodiment.
Figure 10:
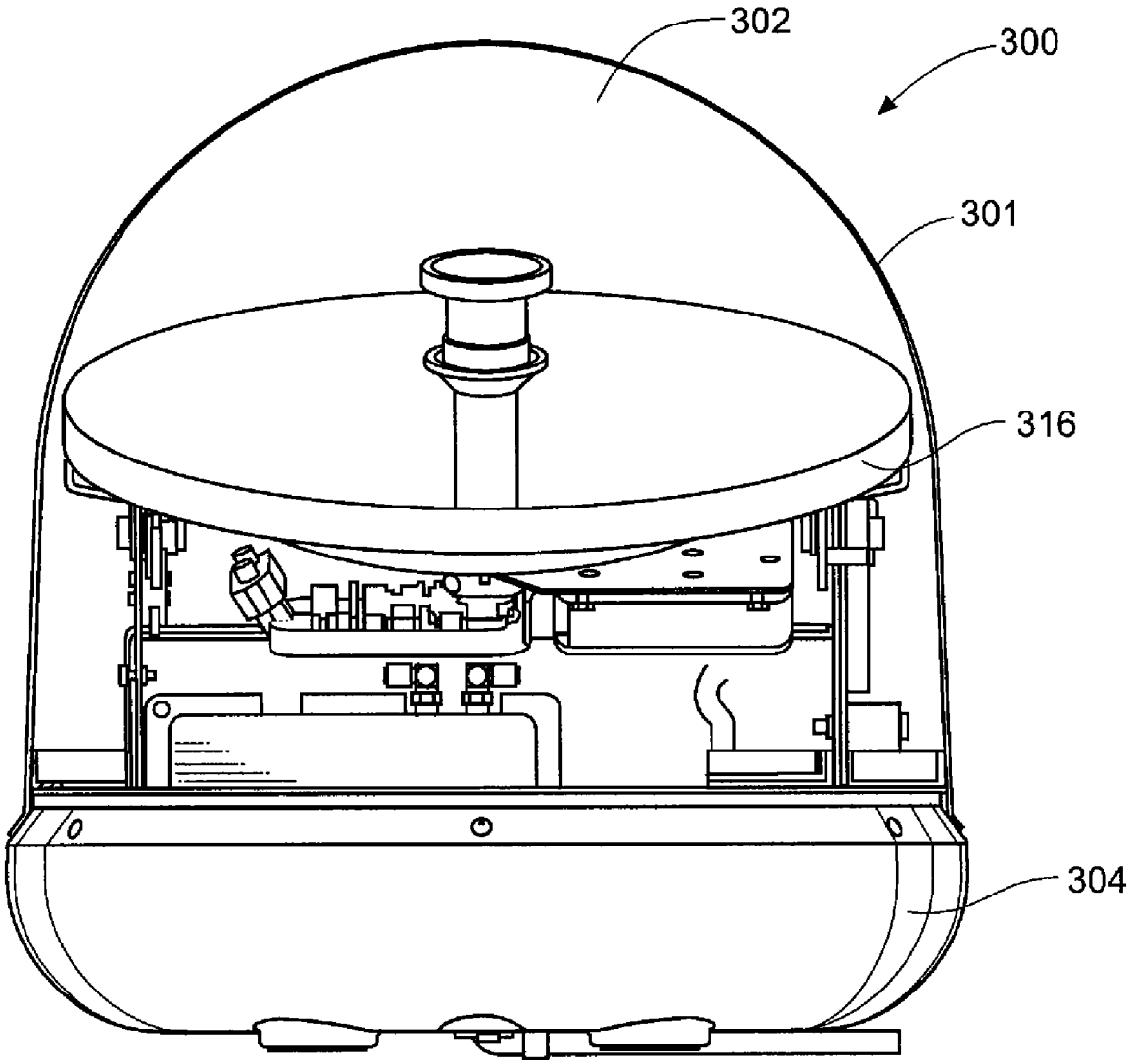
FIG. 10 is an enclosed mobile satellite antenna system according to one example embodiment.
Figure 11:
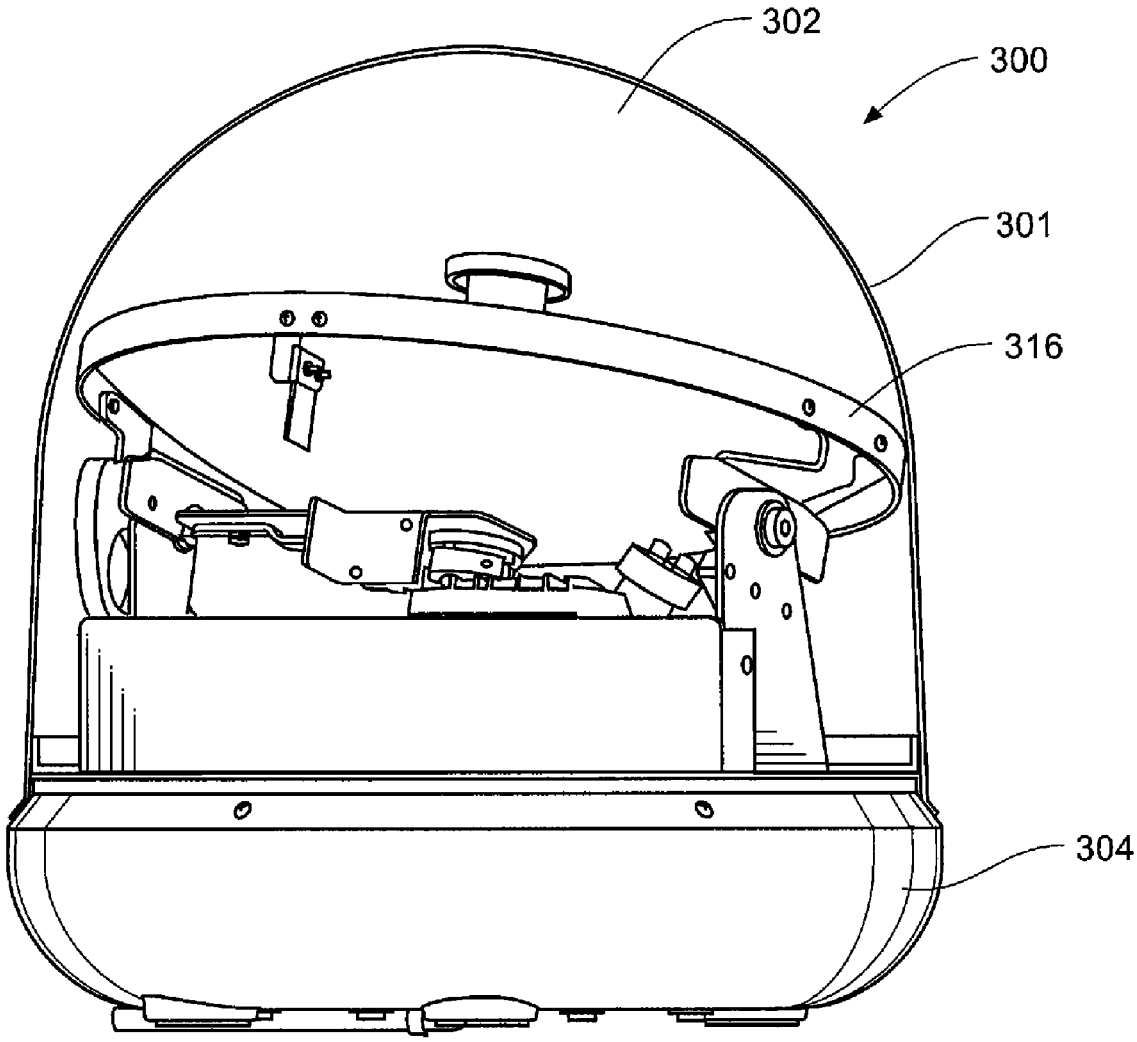
FIG. 11 is an enclosed mobile satellite antenna system according to one example embodiment.
Figure 12:
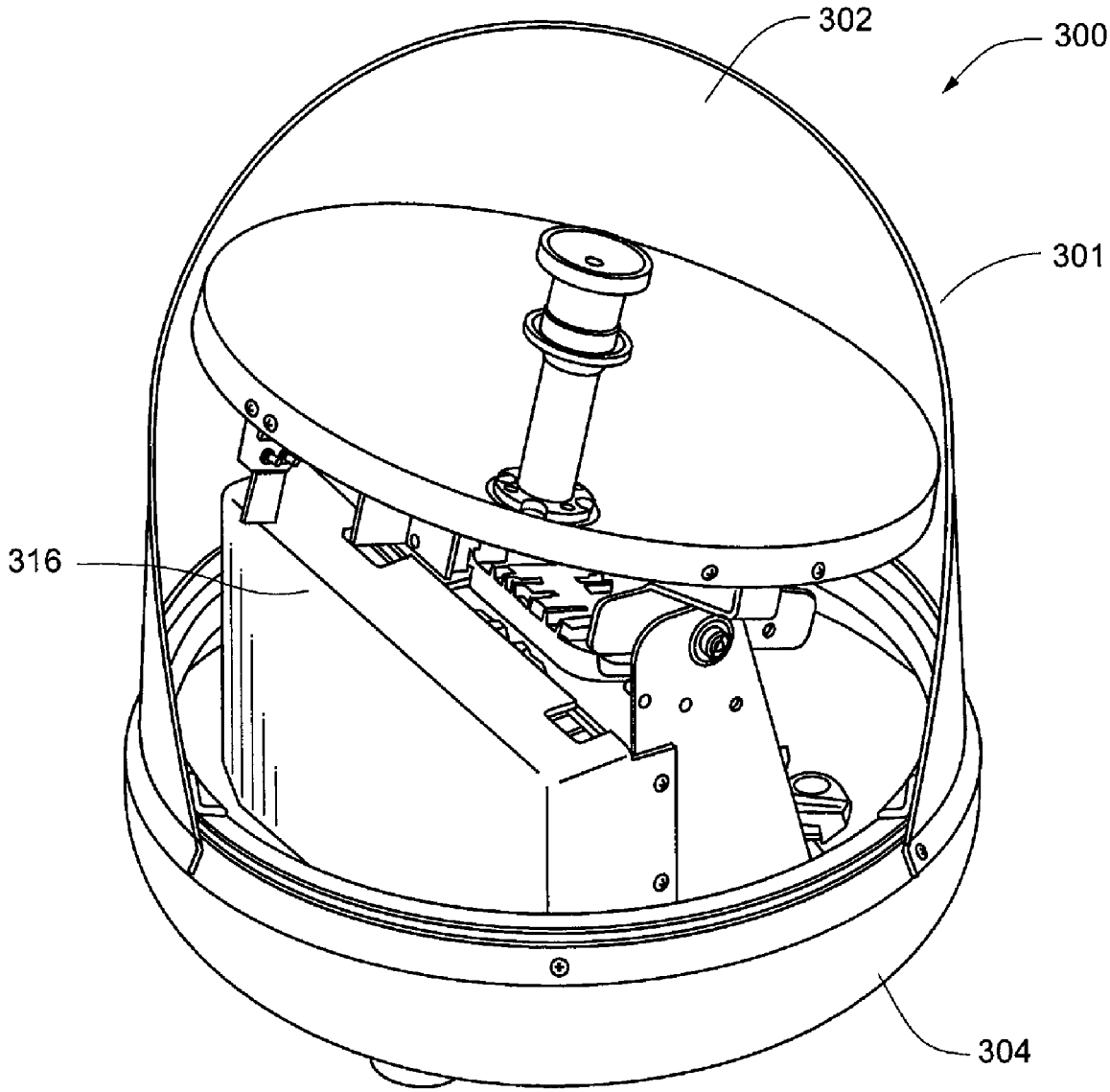
FIG. 12 is an enclosed mobile satellite antenna system according to one example embodiment.
Figure 13:
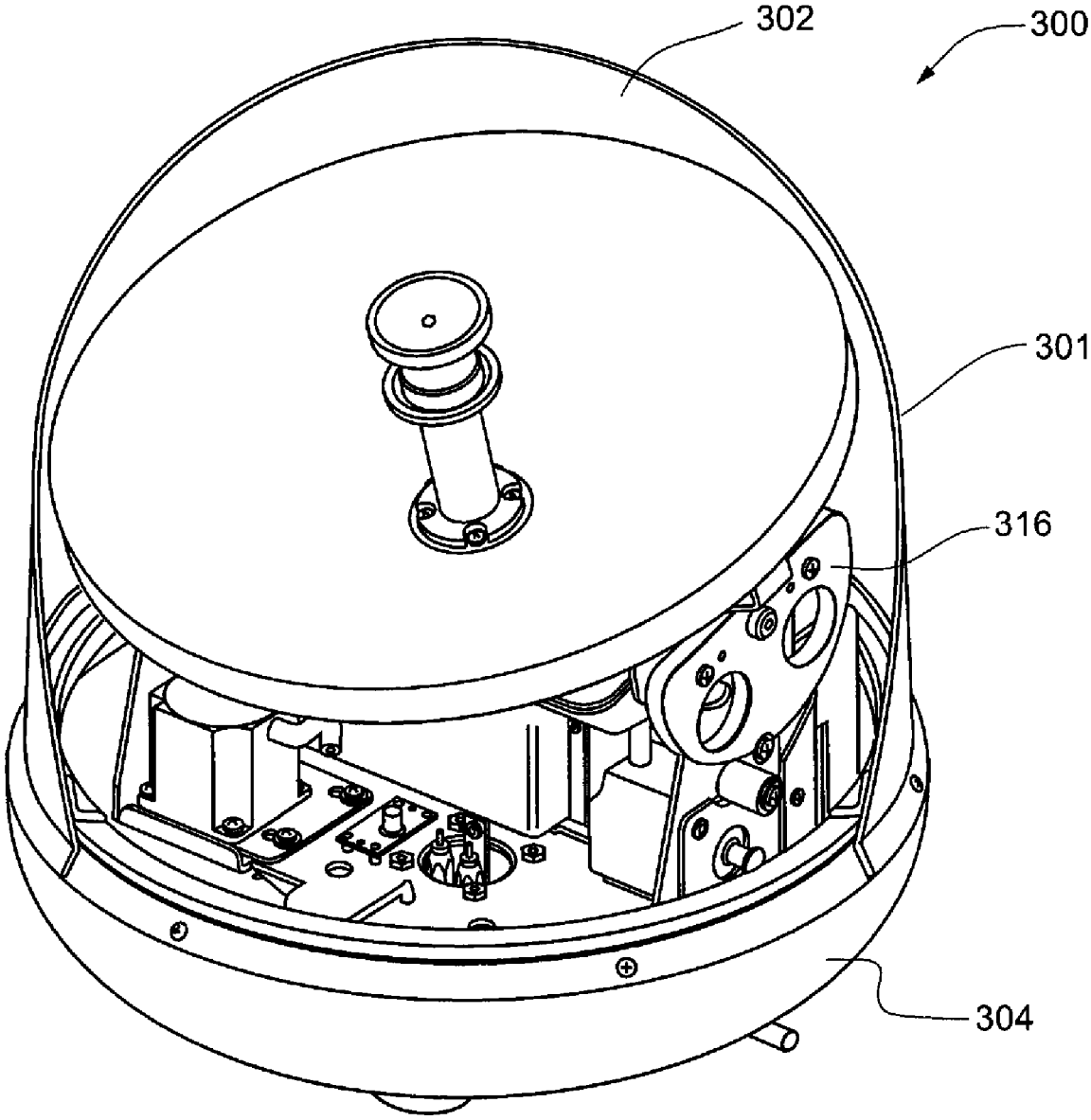
FIG. 13 is an enclosed mobile satellite antenna system according to one example embodiment.

One embodiment of a bracket 200 that can be used to mount mobile satellite antenna system to a vehicle or other structure is depicted in FIG. 5. Bracket 200 can include a mounting portion 202 and a platform portion 204. Mounting portion 202 can be permanently or non-permanently mounted to a vehicle or other structure. Platform portion 204 can be connected to mounting portion 202 with a plurality of nuts and bolts 206. Enclosed mobile satellite antenna system can be rested on or attached to platform portion 204. Platform portion 204 can include a pair of elongated slots 208 that allow the positioning of platform portion 204 relative to mounting portion 202 to be adjusted.

A non-permanently attached enclosed mobile satellite antenna system allows users to use such a system without any modifications to the structure of the vehicle or other structure on which it is mounted. This may be necessary for commercial long-haul drivers who do not drive their own trucks and may not have the authority to permanently modify the vehicle, such as by drilling holes through the vehicle, to accommodate a permanently attached system. A non-permanently attached system can also easily be moved from structure to structure.

A non-permanently attached enclosed mobile satellite antenna system can also be made portable so that it can be used away from the vehicle. As shown in FIGS. 1-4, a dielectric handle 126 can be attached to the enclosure 101 of the system 100. System 100 can be constructed to have a light weight and a small profile to allow for easy manual carrying of the system 100 by handle 126. In one embodiment, handle 126 is configured to allow enclosure 101 to be carried with one hand. In one embodiment, system 100 weights less than 20 pounds. The handle 126 can be positioned such that when system 100 is carried by handle 126, bottom surface 110 is oriented at an angle to the ground. A manually portable system allows satellite reception at remote locations where vehicles do not have access, in non-permanent structures, and in permanent structures not equipped with a standard satellite antenna hardwired to the structure. In another embodiment, a dielectric carrying case can contain the system. It will be apparent to those of skill in the art that various other dielectric features could be used to provide portability to such a system.

An advantage of embodiments of the mobile satellite antenna system of the present invention is that no setup is needed to use the system after it is transported. The satellite antenna dish and related structure contained within the enclosure are transported in the same configuration in which they are used. Thus, the center of mass of the system is the same when it is being carried as when it is being used. The system can therefore be carried from place to place and be immediately ready for use when it is set down and powered on. This allows a user to quickly and easily move the system to new locations without having to expend the significant time it can take to set up prior portable systems that require additional setup at each new location.

Figure 14:
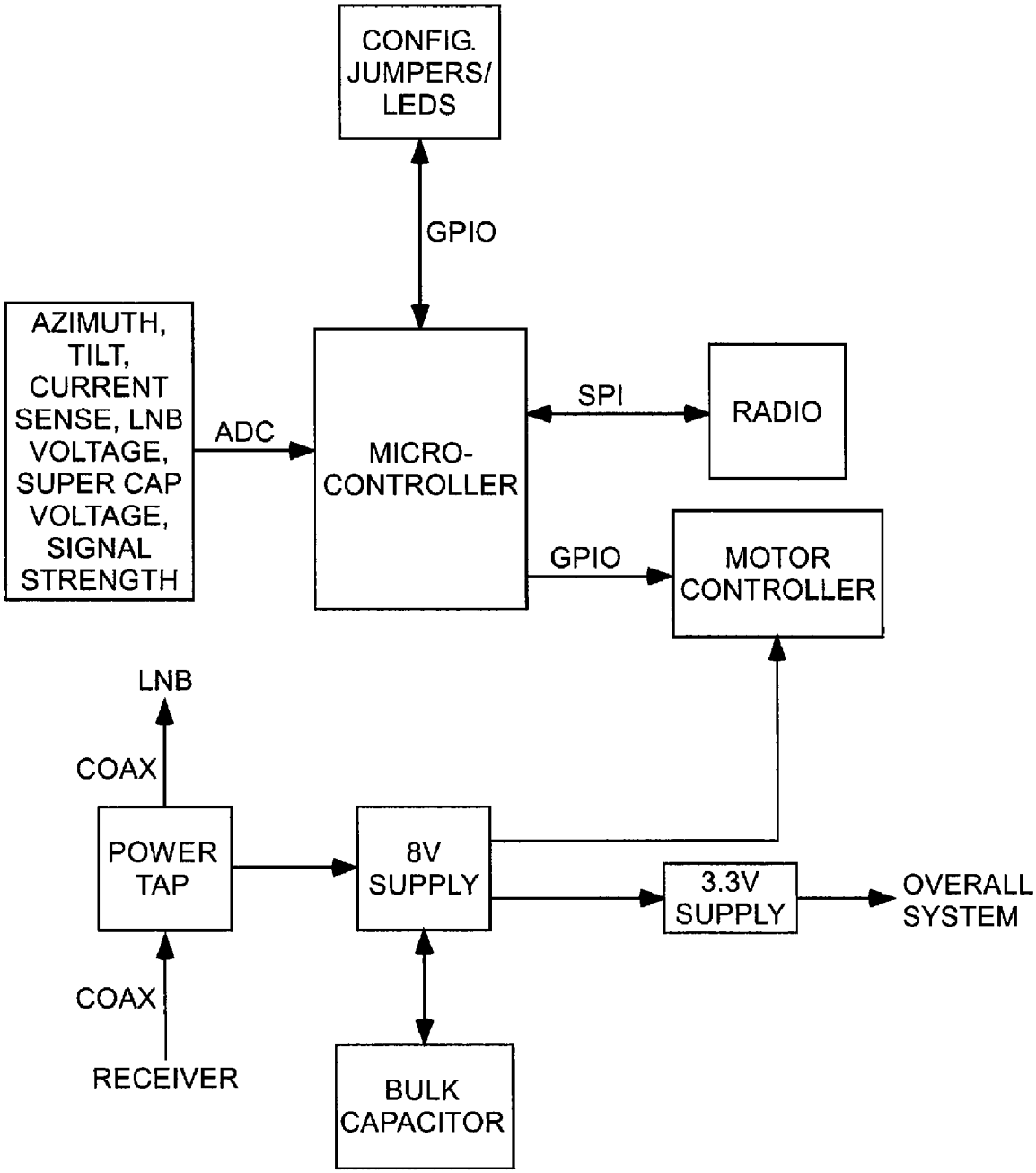
FIG. 14 is a block diagram of a control board for an enclosed mobile satellite antenna system according to one example embodiment.

One embodiment of a satellite antenna system 116 that can be contained within enclosure is depicted in FIGS. 6-9. Satellite antenna system 116 includes a reflector dish 130 and a feedhorn 132. In one embodiment, the reflector dish 130 can be parabolic. Feedhorn 132 collects incoming signals at the focus of dish 130. Incoming satellite signals are channeled from feedhorn 132 to a low noise block (LnB) converter 134. LnB converter 134 amplifies the signals and converts them from microwaves to low frequency signals transmitted through a coaxial cable to at least one receiver. Receiver converts signals so they can appear on the screen of a television. In one embodiment, positioning of dish 130 is carried out by a motorized elevation drive system and a motorized azimuth drive system that are controlled by a control system. A block diagram of a control board for satellite antenna system 116 according to one embodiment is depicted in FIG. 14.

Dish 130 is connected to mounting unit 145. Mounting unit 145 includes a rotatable mount 138 and a tilt mount 146. Rotatable mount 138 is movably connected to bearing mount 140. Rotatable mount 138 rotates by wheel 142 as directed by motor 144. Thus, azimuth or pointing direction of dish 130 is affected by the frictional interaction of wheel 142 against the interior surface 147 of base 148. Base 148 is attached to enclosure 101 to secure mobile satellite antenna system 116 within enclosure 101. In one embodiment, rotation of dish 130 is limited to one complete revolution so as not to damage the cables connecting dish 126 to receiver. In other embodiments, dish 130 can make multiple rotations. When a potentiometer operably attached to the rotatable mount 138 detects that the dish 130 is at the end of its travel, an electronic command can be sent to shut off motor 144. Potentiometer can also transmit feedback to the user regarding the azimuth position of the dish 130.

Elevation of dish 130 is carried out by way of tilt mount 146. Tilt mount 146 is pivotable relative to rotatable mount 138 about pivot pins 152 and is rotated by wheel 154 attached to motor 150. An electronic leveler sensor 133 can be disposed on a sensor bracket 136 attached to the rear face of dish 130. The electronic leveler sensor 133 can transmit feedback to the user regarding the elevation of the dish 130. When the electronic leveler sensor 133 senses that the dish is at the end of its travel, an electronic command can be sent to turn off motor 150.

Figure 15:
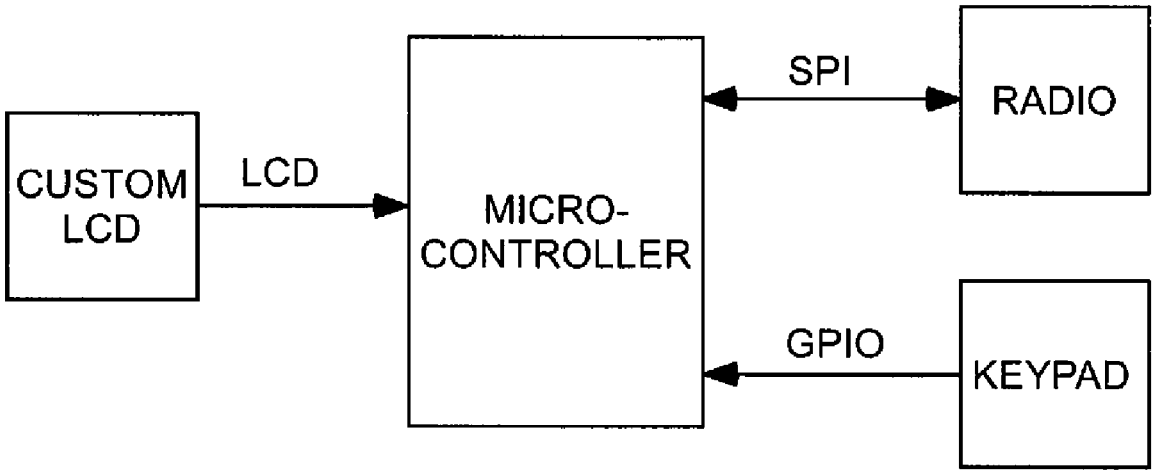
FIG. 15 is a block diagram of a control board for a remote control of an enclosed mobile satellite antenna system according to one example embodiment.

In one embodiment, the parabolic dish 130 of an enclosed mobile satellite antenna system can be positioned via wireless transmission of signals between the system and a remote used to position the antenna. When the enclosed mobile satellite antenna system changes location (or when a vehicle to which it is attached changes location), the system's dish needs to be repositioned to acquire a satellite signal. To reposition the dish, a remote device with an RF transceiver can be used to communicate with a transceiver inside the enclosed mobile satellite antenna system. The remote can be used to reposition the dish from either the inside or the outside of a vehicle or other structure outside of which enclosed mobile satellite antenna system is located. The remote can be programmed to transmit signals to move the dish up and down in elevation and left and right in azimuth. The remote receives feedback from the transceiver in the enclosed mobile satellite antenna system regarding dish position and can display the information alphanumerically or graphically to the user. In one embodiment, the position of the dish in elevation is given in degrees from the horizon and the azimuth position is given graphically and corresponds to the position of the dish relative to the vehicle or other structure. In other embodiments, azimuth can be given relative to the enclosure, the handle, or the coaxial connector. Graphical feedback can also be given to the user when the dish reaches the end of its travel in any direction (up, down, left, or right.). A block diagram of a control board of a remote according to one embodiment is depicted in FIG. 15.

In one embodiment, the procedure to wirelessly acquire a satellite signal when repositioning the dish is to 1) turn on the receiver and navigate to the signal meter screen; 2) enter the zip code or other information into the receiver by following the on-screen instructions to indicate location; 3) use the up and down buttons on the remote to move the dish to the correct elevation as displayed on the signal meter screen; 4) use the left and right buttons on the remote to rotate the dish until the satellite signal is observed on the signal meter screen; and 5) use all four positioning arrows to fine tune the position of the dish to maximize the satellite signal acquisition. In another embodiment, the dish can be positioned via a wired connection to a remote or other user interface. The dish can be positioned as described above with or without direct user positioning. In order to eliminate direct user positioning, the wireless positioning signal can be transmitted and received to automatically position the dish.

Positioning of the dish and acquisition of satellite signals can be accomplished by various means of automatic and semi-automatic positioning. The system can also include means for automatically leveling the satellite dish as it rotates. Such procedures are disclosed in U.S. Pat. Nos. 6,538,612; 6,710,749; 6,864,846; 6,937,199; and 7,301,505, which are hereby incorporated by reference in their entirety, except for the claims and any express definitions that are inconsistent with the present application.

In one embodiment, signals can be transmitted wirelessly from the satellite antenna system to the receiver. Once the satellite antenna system acquires a satellite signal, such as a 1.2 GHz Ku-band signal, it must then be transmitted to the receiver, often located in the interior of a vehicle or other structure. The signal is first modified through a series of electronics in the satellite antenna system to another frequency, such as 2.4 or 5.2 GHz. The signal is then transmitted from the outside of the structure to the inside of the structure wirelessly. Inside the structure, the wirelessly transmitted signal is received and, through a series of electronics, modified back to its original 1.2 GHz frequency and transmitted via wire to the receiver. In other embodiments, satellite antenna system can acquire various other satellite signals, such as, for example, Ka-band signals.

Wireless communication of dish positioning and signal transmission allows for easy installation of enclosed mobile satellite antenna systems because few or no wires or harnesses need to be passed from the outside of a structure, such as a vehicle, into the interior of the structure. In addition, fewer wires are needed on the inside of the structure. Wireless communication as described above can also be used with non-mobile satellite antenna applications.

In another embodiment, power can be supplied to an enclosed mobile satellite antenna system to power the motors, satellite signal acquisition and amplification devices, and ancillary electronics by sources that do not require additional harnesses or wiring. In one embodiment, power is transmitted to the enclosed satellite antenna system from the receiver through the coaxial cable that is also used to transmit satellite signals from the antenna system to the receiver (if not done wirelessly). Alternatively, solar power generated by a photovoltaic cell or wind power such as captured using a small turbine can be used to power the enclosed mobile satellite antenna system. Power from either of these sources (located outside of the vehicle) can be transmitted by a coaxial cable and stored inside the enclosed mobile satellite antenna system with a battery. In one embodiment, the battery can be a standalone battery located in the enclosed mobile satellite antenna system enclosure. Alternatively, the battery can be included on the system's electronic control unit in the form of a supercapacitor or battery on the PCB.

When dish positioning is performed wirelessly, powering the enclosed mobile satellite antenna system with the receiver allows for installation and operation with only a single coaxial cable between the exterior of a structure and the interior of the structure. This also makes the antenna fully functional whenever the receiver is turned on, so there need be no human interaction with the antenna system because all control of the dish can be done automatically. This makes the viewing experience more similar to the non-mobile environment where the user does not need to reposition the dish each time the user desires programming. When the antenna system is powered through solar or wind power and the dish positioning is controlled wirelessly, no wires need to be passed between the interior and the exterior of a structure.

Another embodiment of an enclosed mobile satellite antenna system 300 is depicted in FIGS. 10-13. Enclosed mobile satellite antenna system 300 includes an enclosure 301 with a satellite antenna system 316 therein for acquiring and transmitting a satellite signal. Enclosure 301 can include a cover 302 and a base 304. Note that enclosed mobile satellite antenna system 300 is shown with a portion of cover 302 missing so that the interior satellite antenna system 316 can be displayed. Satellite antenna system 316 includes similar componentry and functions similarly to satellite antenna system 116 described previously. Enclosure 301 can optionally be provided with a handle to provide for easily transportability and manual carrying of enclosed mobile satellite antenna system 300.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A motorized antenna system, comprising:

a generally rigid enclosure having a cover and a base, the cover comprised of an electromagnetic wave permeable material, wherein the cover and base define an enclosed a volume, the enclosure configured to enable both manual transportability of the motorized antenna system and automated operation of the motorized antenna system without a substantial change in the volume of the enclosure or repositioning of the cover or base, the enclosure having disposed within the enclosed volume of the enclosure:

an antenna;

a motorized drive system configured to selectively adjust a position of the antenna; and a control system connected to the motorized drive system to control automated operation of the motorized antenna system, wherein the motorized antenna system weighs less than 15 pounds.

2. The motorized antenna system of claim 1, further comprising a handle connected to an outer surface of the enclosure.

3. The motorized antenna system of claim 1, further comprising one or more feet protruding generally downwardly from the enclosure.

4. The motorized antenna system of claim 3, wherein a notch is defined in a side of the feet.

5. The motorized antenna system of claim 1, further comprising an anti-theft mechanism disposed in the enclosure.

6. The motorized antenna system of claim 1, further comprising one or more solar cells disposed on the enclosure.

7. The motorized antenna system of claim 1, wherein the motorized drive system is configured to be powered through a coaxial connector on an exterior surface of the enclosure.

8. The motorized antenna system of claim 1, wherein the antenna comprises:

a satellite dish having a front side configured to reflect incoming signals towards a focal point, and a back side;

a feedhorn configured to collect incoming signals concentrated by the satellite dish; and a low noise block converter located behind the satellite dish and configured to receive incoming signals from the feedhorn, amplify and convert the incoming signals to received signals.

9. The motorized antenna system of claim 1, wherein the control system operates to automatically position the antenna to acquire a signal upon powering on the motorized antenna system.

10. A motorized antenna system, comprising:

a generally rigid enclosure having a cover and a base, the cover comprised of an electromagnetic wave permeable material, the enclosure defining a volume and configured to enable both manual transportability of the motorized antenna system and automated operation of the motorized antenna system without a substantial change in the volume of the enclosure or repositioning of the cover or base, the enclosure configured for positioning in a first orientation for automated operation and in a second orientation for manual transport, the enclosure having disposed within the volume of the enclosure an antenna and a motorized drive system configured to selectively adjust a position of the antenna.

11. The motorized antenna system of claim 10, wherein the motorized antenna system weighs less than 15 pounds.

12. The motorized antenna system of claim 10, further comprising a handle disposed on the enclosure configured to allow manual carrying of the satellite antenna system with one hand.

13. The motorized antenna system of claim 10, wherein the antenna comprises:

a satellite dish;

a feedhorn configured to collect incoming signals concentrated by the satellite dish; and a low noise block converter located behind the satellite dish and configured to receive incoming signals from the feedhorn, amplify and convert the incoming signals to received signals.

14. The motorized antenna system of claim 10, wherein control of the position of the antenna is controlled automatically by interaction with a receiver.

15. The motorized antenna system of claim 10, further comprising one or more feet protruding generally downwardly from the enclosure.

16. The motorized antenna system of claim 15, wherein a notch is defined in a sidewall of the feet.

17. The motorized antenna system of claim 10, further comprising an anti-theft mechanism disposed in the enclosure.

18. The motorized antenna system of claim 10, further comprising one or more solar cells disposed on the enclosure.

19. A motorized antenna system, comprising:

a generally rigid enclosure defining a volume and configured to enable both manual transportability of the motorized antenna system and automated operation of the motorized antenna system without a change in the volume of the enclosure or deployment of the motorized antenna system, the enclosure having disposed within the volume of the enclosure an antenna and a motorized drive system configured to selectively adjust a position of the antenna, wherein the motorized antenna system weighs less than 20 pounds.

20. The motorized antenna system of claim 19, further comprising a handle disposed on the enclosure configured to allow manual carrying of the satellite antenna system with one hand.

21. The motorized antenna system of claim 19, wherein the antenna comprises:

a satellite dish;

a feedhorn configured to collect incoming signals concentrated by the satellite dish; and a low noise block converter located behind the satellite dish and configured to receive incoming signals from the feedhorn, amplify and convert the incoming signals to received signals.

22. The motorized antenna system of claim 19, wherein control of the position of the antenna is controlled automatically by interaction with a receiver.

23. The motorized antenna system of claim 19 further comprising one or more feet protruding generally downwardly from the enclosure.

24. The motorized antenna system of claim 23, wherein the feet are configured to attach the motorized antenna system to a mounting bracket.

25. The motorized antenna system of claim 19, wherein the motorized antenna system weighs less than 15 pounds.

* * * * *

US007679573C1

(12) INTER PARTES REEXAMINATION CERTIFICATE (1276th)

United States Patent
Shuster et al.

(10) Number: US 7,679,573 C1
(45) **Certificate Issued: *Jun. 2, 2016**

(54) ENCLOSED MOBILE/TRANSPORTABLE MOTORIZED ANTENNA SYSTEM

(75) Inventors: Sam Shuster, Edina, MN (US); Lael King, Minneapolis, MN (US)

(73) Assignee: ELECTRONIC CONTROLLED SYSTEMS, INC., Bloomington, MN (US)

Reexamination Request:
No. 95/000,560, Jul. 19, 2010

Reexamination Certificate for:

| | |
|---|---|
| Patent No.: | **7,679,573** |
| Issued: | **Mar. 16, 2010** |
| Appl. No.: | **12/004,099** |
| Filed: | **Dec. 19, 2007** |

( * ) Notice: This patent is subject to a terminal disclaimer.

Related U.S. Application Data

(60) Provisional application No. 60/888,673, filed on Feb. 7, 2007.

(51) Int. Cl.
*H01Q 3/00* (2006.01)

(52) U.S. Cl.
CPC ..... *H01Q 3/00* (2013.01)

(58) Field of Classification Search
CPC ..... H01Q 3/00
USPC ..... 343/766
See application file for complete search history.

(56) References Cited

To view the complete listing of prior art documents cited during the proceeding for Reexamination Control Number 95/000,560, please refer to the USPTO's public Patent Application Information Retrieval (PAIR) system under the Display References tab.

*Primary Examiner* — My-Trang Ton

(57) ABSTRACT

An enclosed satellite antenna system can include a generally rigid enclosure defining a volume that is configured to enable both manual transportability of the satellite antenna system and automated operation of the satellite antenna system without a substantial change in the volume of the enclosure or manual repositioning of the satellite antenna system. The enclosure can have disposed therein a satellite dish, a feedhorn configured to collect incoming signals concentrated by the satellite dish, and a low noise block converter configured to receive incoming signals from the feedhorn, amplify and convert the incoming signals to received signals, and transmit the received signals to at least one receiver. A motorized elevation dravie system can be configured to selectively adjust an elevation of the satellite dish and a motorized azimuth drive system can be configured to selectively rotate the satellite dish. A control system can be connected to the elevation drive system and the azimuth drive system to control automated operation of the satellite antenna system.

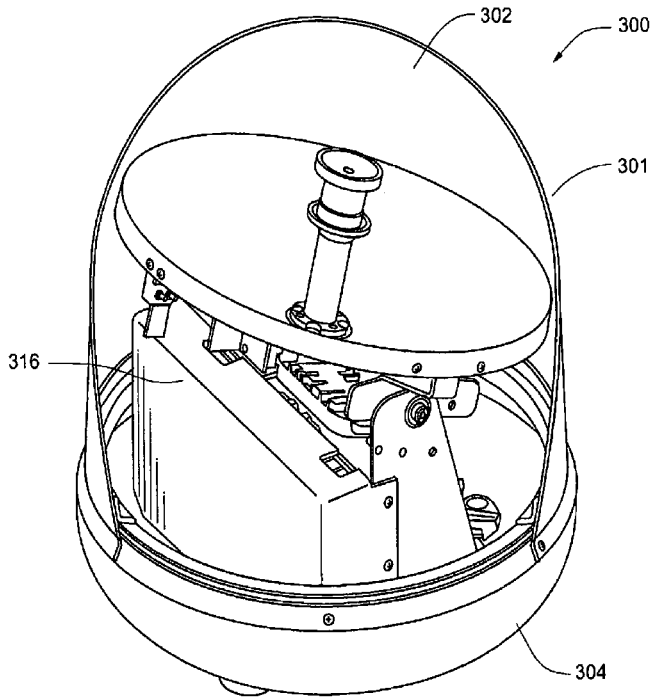

INTER PARTES REEXAMINATION CERTIFICATE

THE PATENT IS HEREBY AMENDED AS INDICATED BELOW.

AS A RESULT OF REEXAMINATION, IT HAS BEEN DETERMINED THAT:

The patentability of claims 5 and 17 is confirmed.

Claims 1-4, 8-16 and 19-25 are cancelled.

Claims 6, 7 and 18 were not reexamined.

* * * * *